US012404129B2

(12) United States Patent
Inoue et al.

(10) Patent No.: US 12,404,129 B2
(45) Date of Patent: Sep. 2, 2025

(54) CONVEYANCE APPARATUS THAT CONTROLS SPEED TOWARD SHEET OF SECOND CURSOR PRESSING SHEET AGAINST FIRST CURSOR

(71) Applicant: KYOCERA Document Solutions Inc., Osaka (JP)

(72) Inventors: Toshiaki Inoue, Osaka (JP); Takashi Kotani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 6 days.

(21) Appl. No.: 18/637,774

(22) Filed: Apr. 17, 2024

(65) Prior Publication Data

US 2024/0359935 A1 Oct. 31, 2024

(30) Foreign Application Priority Data

Apr. 27, 2023 (JP) ..... 2023-073082

(51) Int. Cl.

*B65H 9/10* (2006.01)
*B65H 7/02* (2006.01)
*B65H 43/00* (2006.01)

(52) U.S. Cl.

CPC ..... *B65H 9/101* (2013.01); *B65H 7/02* (2013.01); *B65H 43/00* (2013.01); *B65H 2402/54* (2013.01); *B65H 2513/10* (2013.01); *B65H 2513/11* (2013.01); *B65H 2513/40* (2013.01); *B65H 2515/30* (2013.01); *B65H 2801/27* (2013.01)

(58) Field of Classification Search

CPC . B65H 9/101; B65H 5/36; B65H 9/06; B65H 31/20; B65H 31/34; B65H 31/38; B65H 2405/11425

See application file for complete search history.

(56) References Cited

U.S. PATENT DOCUMENTS 4,657,239 A * 4/1987 Ikesue ..... B65H 9/101 271/227

FOREIGN PATENT DOCUMENTS

JP 2009286568 A 12/2009
JP 2019052031 A 4/2019

* cited by examiner

*Primary Examiner* — Jeremy R Severson
(74) *Attorney, Agent, or Firm* — IP Business Solutions, LLC.

(57) ABSTRACT

A conveyance apparatus includes a conveyance unit, a first cursor, a second cursor, and a controller. The conveyance unit conveys a sheet in a first direction. The first cursor regulates movement of the sheet in a second direction intersecting the first direction. The second cursor presses the sheet against the first cursor. The controller controls a speed at which the second cursor positioned away from the sheet moves toward the sheet.

3 Claims, 5 Drawing Sheets

CONVEYANCE APPARATUS THAT CONTROLS SPEED TOWARD SHEET OF SECOND CURSOR PRESSING SHEET AGAINST FIRST CURSOR

INCORPORATION BY REFERENCE

This application claims priority to Japanese Patent Application No. 2023-073082 filed on 27 Apr. 2023, the entire contents of which are incorporated by reference herein.

BACKGROUND

The present disclosure relates to a conveyance apparatus.

An image forming apparatus that forms an image on a sheet is provided with a conveyance apparatus that conveys sheets such as paper to locations within the image forming apparatus. Such a conveyance apparatus has a function of arranging positions of sheets. As a device having a function of arranging positions of sheets, for example, a relay conveyance apparatus and a paper conveyance unit are generally known.

SUMMARY

As one aspect of the present disclosure, a technique that is further improved from the above technique is proposed.

A conveyance apparatus according to one aspect of the present disclosure includes a conveyance unit, a first cursor, a second cursor, and a controller. The conveyance unit conveys a sheet in a first direction. The first cursor regulates movement of the sheet in a second direction intersecting the first direction. The second cursor presses the sheet against the first cursor. The controller includes a processor and controls a speed at which the second cursor positioned away from the sheet moves toward the sheet by executing a control program by the processor.

DETAILED DESCRIPTION

Figure 1:
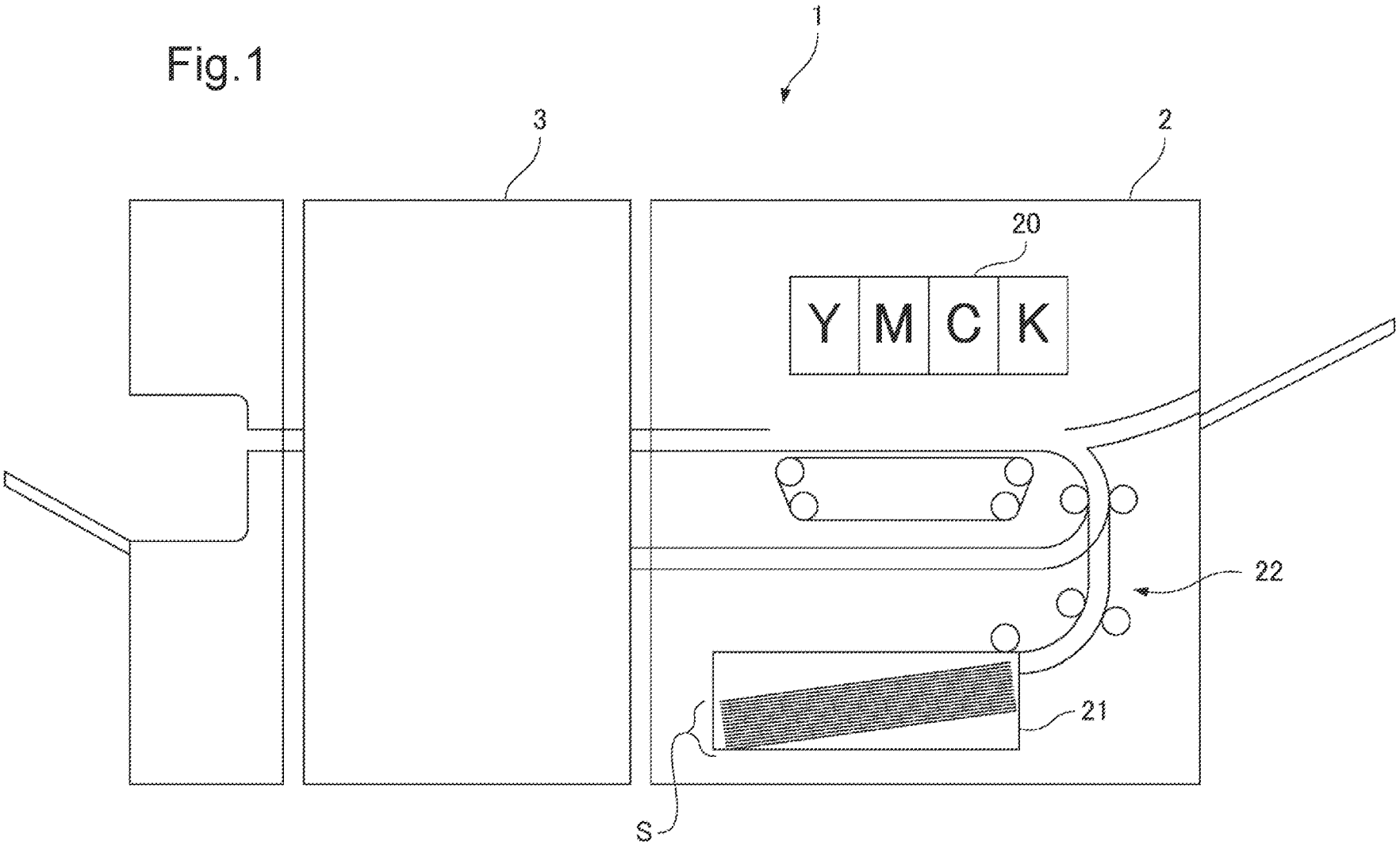
FIG. 1 is a diagram showing a configuration of an image forming system including a conveyance apparatus according to an embodiment of the present disclosure.

Hereinafter, one embodiment of the present disclosure will be described with reference to the drawings. In the drawings, the same or corresponding parts are given the same reference numerals, and the description will not be repeated.

An outline of an image forming system 1 according to an embodiment of the present disclosure will be described with reference to FIG. 1. FIG. 1 is a diagram showing a configuration of the image forming system 1 including a conveyance apparatus 3 according to the embodiment of the present disclosure.

As shown in FIG. 1, the image forming system 1 includes an image forming apparatus 2 and a conveyance apparatus 3. The image forming apparatus 2 is connected to the conveyance apparatus 3. A sheet S on which an image is formed is conveyed from the image forming apparatus 2 to the conveyance apparatus 3. The sheet S conveyed to the conveyance apparatus 3 may be conveyed again to the image forming apparatus 2, or may be conveyed to a location other than the conveyance apparatus 3.

The image forming apparatus 2 forms an image on the sheet S based on image data representing the image. The image forming apparatus 2 is, for example, a printer, a copy machine, or a multi-function printer (MFP). An MFP is an apparatus that has functions of a scanner and/or communication, in addition to the function of forming an image on the sheet S.

The image forming apparatus 2 includes an image forming unit 20, an accommodation unit 21, and an image forming conveyance unit 22.

The image forming unit 20 forms an image corresponding to image data on the sheet S based on the image data. The image forming unit 20 forms a toner image on the sheet S by, for example, an electrophotographic method. The image forming unit 20 may form an image on the sheet S by an inkjet method.

The accommodation unit 21 accommodates the sheet S on which an image is formed. Specifically, the accommodation unit 21 is a tray that accommodates the sheet S, a manual feed tray, or the like.

The image forming conveyance unit 22 conveys the sheet S accommodated in the accommodation unit 21 toward the inside and outside of the image forming unit 20. The image forming conveyance unit 22 conveys the sheet S into the image forming unit 20 and the conveyance apparatus 3 to be described later by a roller and/or a belt that rotates by the roller.

Figure 2:
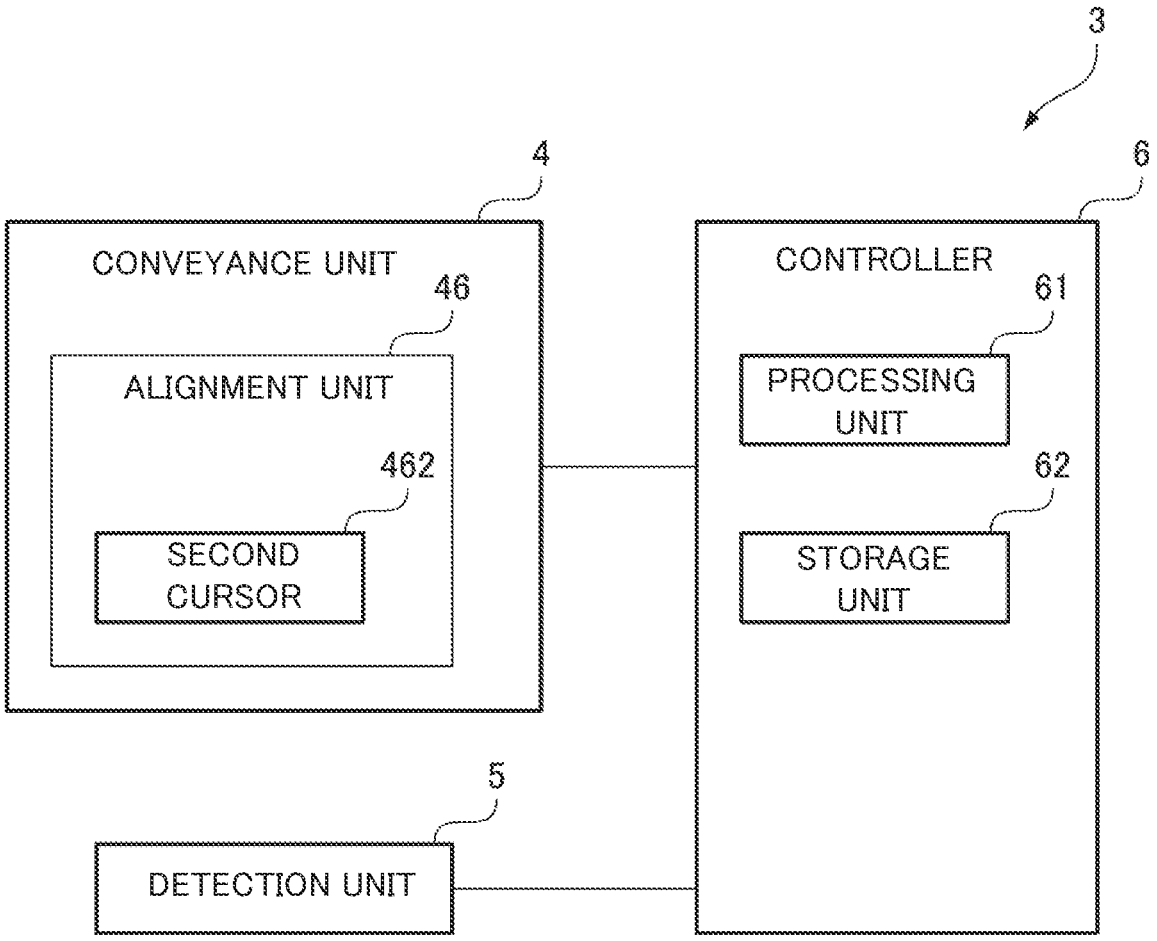
FIG. 2 is a block diagram of the conveyance apparatus.
Figure 3:
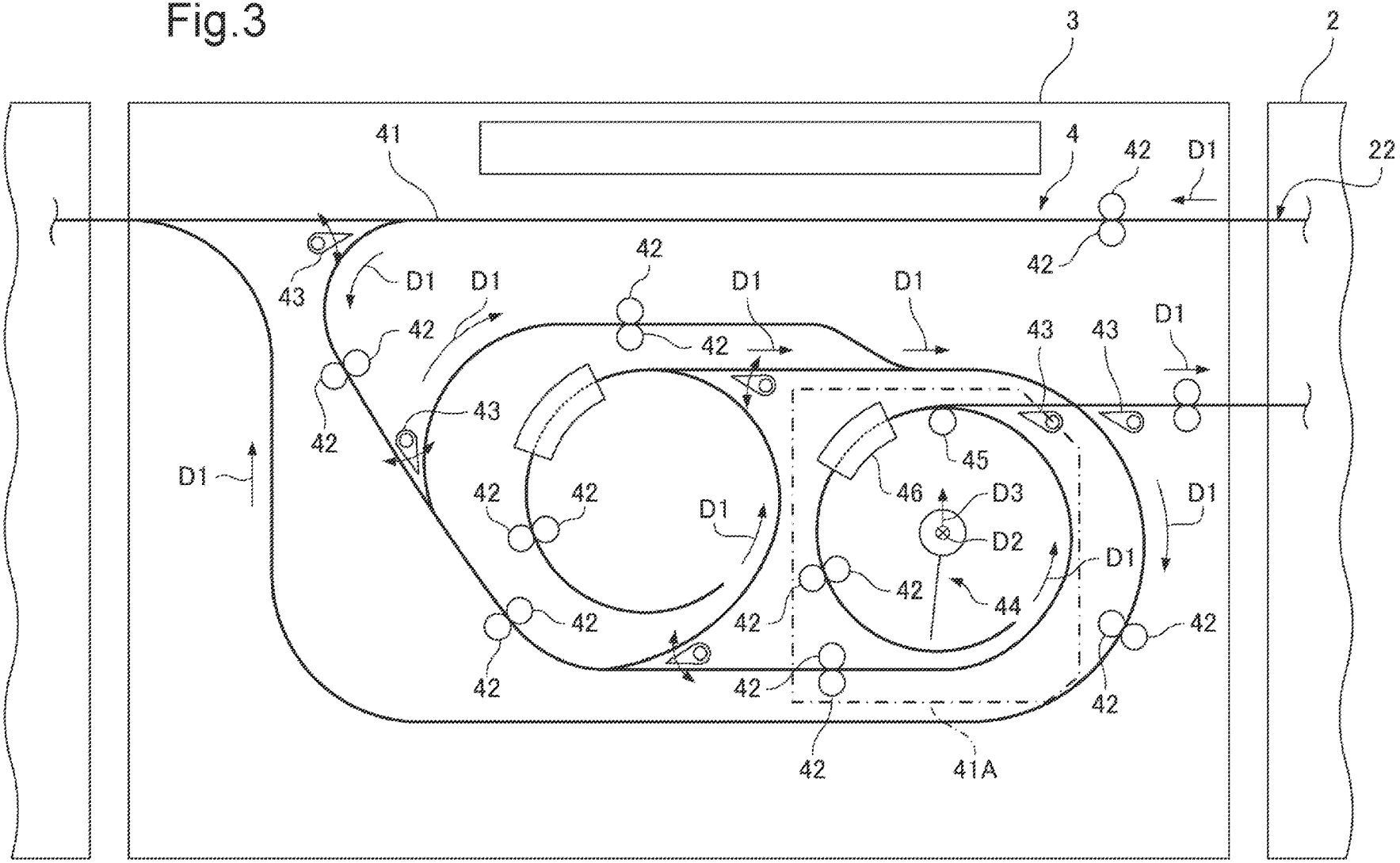
FIG. 3 is a diagram showing a configuration of the conveyance apparatus.
Figure 4:
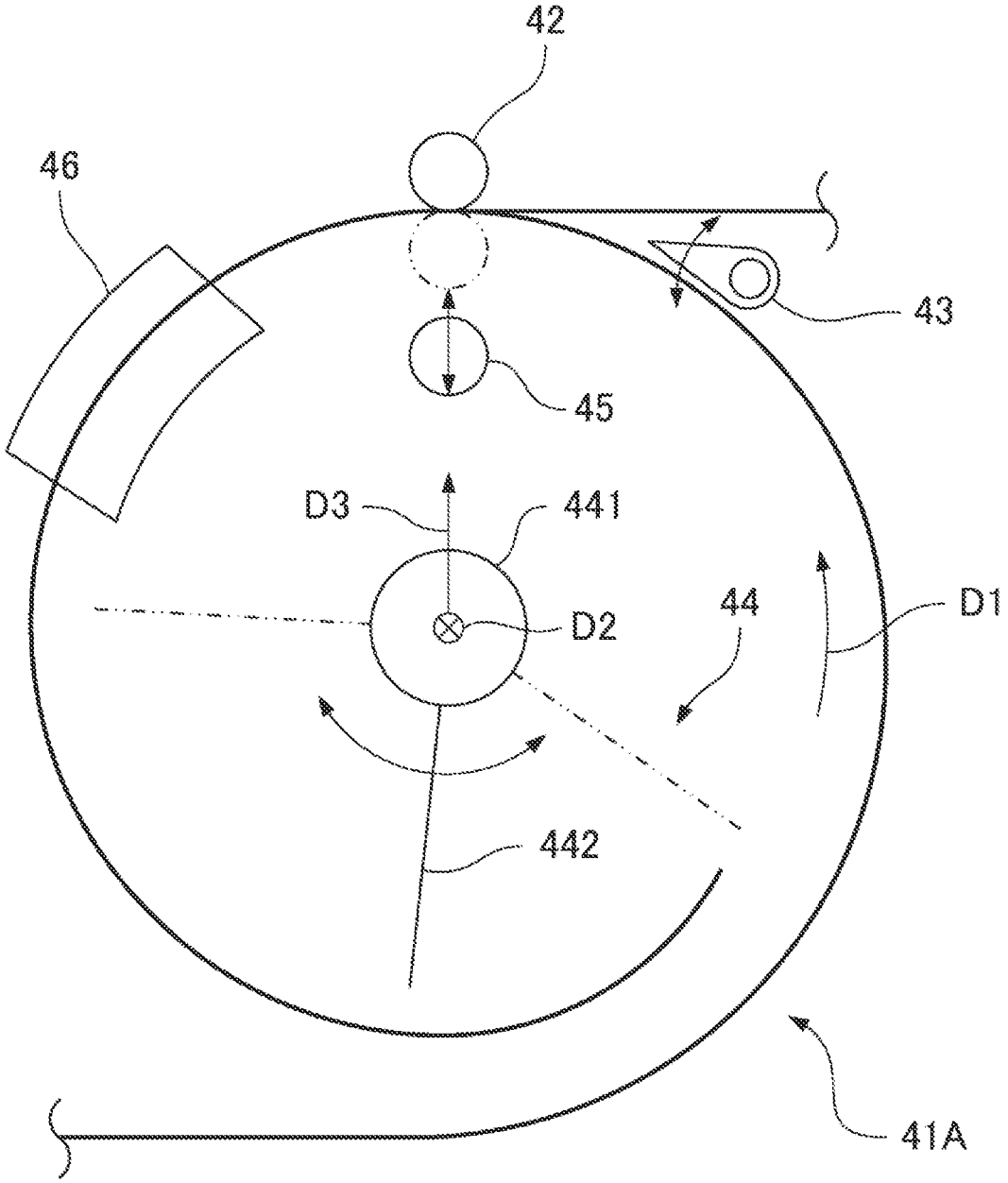
FIG. 4 is an enlarged view of a drum conveyance path in FIG. 3.
Figure 5:
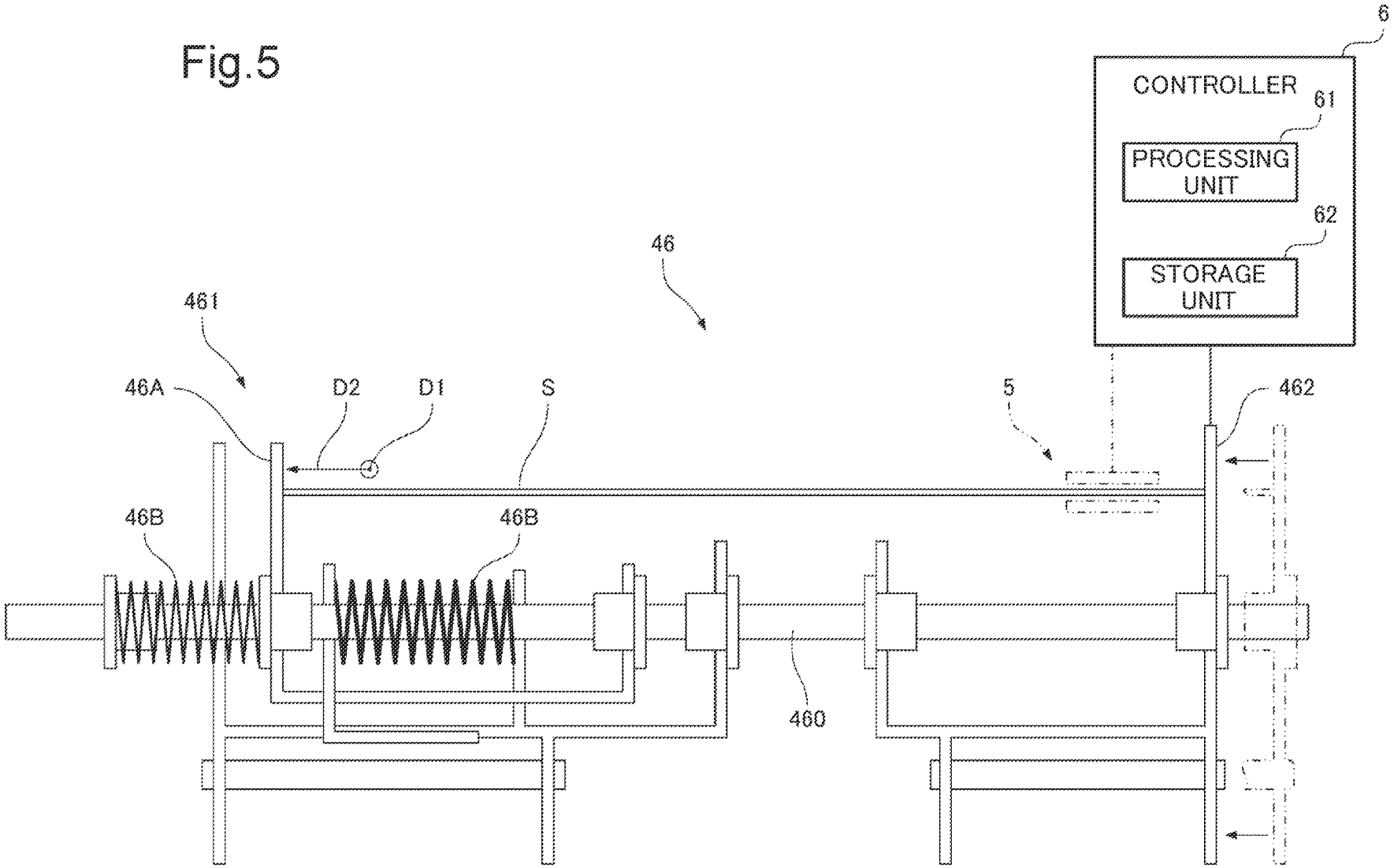
FIG. 5 is a diagram showing a mechanism for adjusting the position of a sheet in an alignment unit.

A configuration of the conveyance apparatus 3 will be described with reference to FIGS. 2 to 5. FIG. 2 is a block diagram of the conveyance apparatus 3. FIG. 3 is a diagram showing the configuration of the conveyance apparatus 3. FIG. 4 is an enlarged view of a drum conveyance path 41A in FIG. 3. FIG. 5 is a diagram showing a mechanism for adjusting the position of the sheet S in an alignment unit 46.

As shown in FIG. 2, the conveyance apparatus 3 includes a conveyance unit 4, a detection unit 5, and a controller 6.

As shown in FIG. 3, the conveyance unit 4 conveys the sheet S, which is conveyed into the conveyance apparatus 3 by the image forming conveyance unit 22, within the conveyance apparatus 3. Hereinafter, a direction in which the sheet S is conveyed will be referred to as a "first direction D1." A direction intersecting the first direction D1 will be referred to as a "second direction D2." The second direction D2 is often a direction along the width of the sheet S.

The conveyance unit 4 conveys the sheet S conveyed from the image forming conveyance unit 22 into the conveyance apparatus 3 to portions within the conveyance apparatus 3. The conveyance unit 4 includes a conveyance path 41, a conveyance roller 42, and a switching device 43.

The conveyance path 41 is a path in the first direction D1. Since the sheet S is conveyed to locations within the conveyance apparatus 3, the first direction D1 branches out toward the locations within the conveyance apparatus 3.

The conveyance roller 42 conveys the sheet S in the first direction D1. The conveyance rollers 42 are disposed along the conveyance path 41 at intervals suitable for conveying the sheet S.

The switching device 43 is disposed at a position where the conveyance path 41 branches out. A conveyance destination of the sheet S conveyed within the conveyance path 41 is switched within the conveyance apparatus 3 by the switching device 43.

The conveyance destination within the conveyance apparatus 3 includes a drum conveyance path 41A which is a part of the conveyance path 41. The drum conveyance path 41A is a drum-shaped path. Specifically, the drum shape is a shape that draws a curve in a third direction D3 intersecting the first direction D1 and the second direction D2. The third direction D3 is often a direction along the thickness of the sheet S. The drum conveyance path 41A switches back the sheet S after arranging the position of the sheet S in the second direction D2. Hereinafter, for convenience of description, a direction in which the sheet S is conveyed before being switched back may be referred to as a forward direction.

As shown in FIG. 4, the conveyance unit 4 further includes a stopper 44, a movable roller 45, and an alignment unit 46. The stopper 44, the movable roller 45, and the alignment unit 46 are disposed along the drum conveyance path 41A.

The stopper 44 includes a rotation shaft 441 and a stop plate 442.

The rotation shaft 441 has a longitudinal portion in the second direction D2 and is disposed inside the drum conveyance path 41A. As shown in FIG. 4, the inside of the drum conveyance path 41A includes a position surrounded by the drum conveyance path 41A. The rotation shaft 441 rotates around the longitudinal portion in the second direction D2.

The stop plate 442 is a plate attached to the rotation shaft 441 in a radial direction with respect to the rotation of the rotation shaft 441. The stop plate 442 rotates together with the rotation shaft 441, blocks the drum conveyance path 41A, and partially blocks the drum conveyance path 41A. Thereby, the movement of the sheet S conveyed to the drum conveyance path 41A in the first direction D1 is regulated by the stop plate 442. As a result, the sheet S conveyed in the forward direction can be prevented from coming out of the drum conveyance path 41A.

The movable roller 45 is provided downstream of the stop plate 442 in the forward direction. The movable roller 45 moves toward the drum conveyance path 41A. The movable roller 45 approaching the drum conveyance path 41A blocks the drum conveyance path 41A and blocks the drum conveyance path 41A. On the other hand, as the movable roller 45 moves away from the drum conveyance path 41A, the drum conveyance path 41A is opened.

As shown in FIG. 5, the alignment unit 46 includes a shaft 460, a first cursor 461, and a second cursor 462.

The shaft 460 is a shaft having a longitudinal portion in the second direction D2.

The first cursor 461 regulates the movement of the sheet S in the second direction D2. The first cursor 461 includes a slider 46A and a spring 46B.

The slider 46A is supported by the shaft 460 to be movable in the second direction D2, and is a portion that regulates the movement of the sheet S in the second direction D2. The sheet S whose movement in the second direction D2 is regulated generates a load on the slider 46A in the second direction D2.

The spring 46B is attached to the shaft 460 to alleviate a load instantaneously generated on the sheet S by the slider 46A against which the sheet S is pressed. In the example shown in FIG. 5, two springs 46B, 46B are attached to the shaft 460 at positions sandwiching the slider 46A.

The second cursor 462 presses the sheet S against the first cursor 461. As shown in FIG. 5, when the sheet S is disposed between the second cursor 462 positioned away from the sheet S and the first cursor 461, the second cursor 462 moves toward the sheet S in the second direction D2. The second cursor 462 that has come into contact with the sheet S presses the sheet S against the slider 46A of the first cursor 461.

When the sheet S is pressed against the slider 46A, the spring 46B alleviates a load instantaneously generated on the sheet S. Thus, it is possible to prevent a large compressive load from being instantaneously applied to the sheet S.

The detection unit 5 detects a buckling load of the sheet S. The detection unit 5 includes, for example, a sensor that detects the thickness of the sheet S. When there is a detection result of such a sensor, a buckling load of the sheet S being conveyed can be detected using a correlation between the thickness of the sheet S and the buckling load.

The detection unit 5 is not limited to a sensor that measures the thickness of the sheet S as long as it can detect a buckling load of the sheet S. For example, the detection unit 5 may be a combination of a memory that records a buckling load for each type of sheet S and a computer that acquires a buckling load from the memory. Specifically, the image forming unit 20 generally forms an image on the sheet S after selecting the type of sheet S. When a buckling load corresponding to the type of sheet S is stored in the memory, the computer can acquire a buckling load corresponding to the selected sheet S.

The controller 6 includes a processing unit 61 and a storage unit 62.

The processing unit 61 is, for example, a processor. The processor is, for example, a central processing unit (CPU). The processing unit 61 controls the second cursor 462 by executing a control program stored in the storage unit 62.

The storage unit 62 stores a control program. The storage unit 62 is constituted by, for example, a read only memory (ROM), a random access memory (RAM), and/or a solid state drive (SSD). The storage unit 62 may include an external memory. The external memory is a removable medium. The storage unit 62 may include, for example, a Universal Serial Bus (USB) memory and/or a secure digital (SD) card as the external memory.

The controller 6 controls a speed at which the second cursor 462 positioned away from the sheet S moves toward the sheet S. The controller 6 controls the speed at which the second cursor 462 moves toward the sheet S, and thus the second cursor 462 can be brought into contact with the sheet S at a speed lower than the speed at which a compressive load larger than a buckling load of the sheet S is instantaneously generated. As a result, when the sheet S is pressed against the sheet S by the second cursor 462, the sheet S can be prevented from buckling.

The controller 6 decreases the speed toward the sheet S as the buckling load detected by the detection unit 5 decreases. Thus, even for a sheet S with a small buckling load, the second cursor 462 can be brought into contact with the sheet S at a speed lower than the speed at which a compressive load larger than the buckling load of the sheet S is instantaneously generated.

Incidentally, the above-described general relay conveyance apparatus and the above-described general paper conveyance unit do not distinguish whether the sheet is thin paper or thick paper. Thus, thin paper with a small buckling load is likely to buckle when the paper is aligned by the above-described general relay conveyance apparatus or the above-described general paper conveyance unit.

On the other hand, according to the conveyance apparatus 3 of the present disclosure, the position of the sheet S can be adjusted without buckling of various types of sheets S having different buckling loads.

In the above description, the second cursor 462, which does not have an alleviation structure such as the spring 46B for alleviating a load generated on the sheet S when the sheet S contacts the second cursor 462, presses the sheet S against the first cursor 461. However, the gist of the present disclosure is that one cursor whose speed toward the sheet S is controlled presses the sheet S against the other cursor. Thus, one cursor whose speed toward the sheet S is controlled and the other cursor against which the sheet S is pressed may have any structure. For example, one of the cursors whose speed toward the sheet S is controlled may have an alleviation structure like the first cursor 461 described above. Further, the other cursor whose speed toward the sheet S is not controlled may not have an alleviation structure like the second cursor 462 described above.

The embodiment of the present disclosure has been described above with reference to the drawings. However, the present disclosure is not limited to the above-described embodiment, and can be implemented in various forms without departing from the spirit thereof. For ease of understanding, the drawings mainly show each component schematically, and the thickness, length, number, interval, and the like of each component shown in the diagram may be different from the actual ones for convenience of the drawings. Further, the materials, shapes, dimensions, and the like of components shown in the above-described embodiment are merely examples, are not particularly limited, and can be modified in various ways without substantially departing from the configuration of the present disclosure.

The present disclosure provides a conveyance apparatus and has industrial applicability.

While the present disclosure has been described in detail with reference to the embodiments thereof, it would be apparent to those skilled in the art the various changes and modifications may be made therein within the scope defined by the appended claims.

What is claimed is:

1. A conveyance apparatus comprising:

a conveyance unit that conveys a sheet in a first direction;

a first cursor that regulates movement of the sheet in a second direction intersecting the first direction;

a second cursor that presses the sheet against the first cursor;

a controller that includes a processor and controls a speed at which the second cursor positioned away from the sheet moves toward the sheet by executing a control program by the processor; and a detection unit that detects a buckling load of the sheet, wherein the controller decreases the speed as the buckling load detected by the detection unit decreases.

2. The conveyance apparatus according to claim 1, wherein the first cursor or the second cursor has an alleviation structure for alleviating a load generated on the sheet when the sheet comes into contact with the first cursor or the second cursor.

3. The conveyance apparatus according to claim 2, wherein the first cursor or the second cursor has a spring as the alleviation structure.

* * * * *